US007707979B2

(12) United States Patent
Best

(10) Patent No.: US 7,707,979 B2
(45) Date of Patent: May 4, 2010

(54) VALVETRAIN SWITCHABLE LEVER ARM FOR INTERNAL COMBUSTION ENGINE USING COLLAPSING PIVOT ELEMENT AT CENTER PIVOT

(75) Inventor: Richard Best, Garden City, MI (US)

(73) Assignee: Schaeffler KG, Herzogenaurach (DE)

( * ) Notice: Subject to any disclaimer, the term of this patent is extended or adjusted under 35 U.S.C. 154(b) by 373 days.

(21) Appl. No.: 11/780,743

(22) Filed: Jul. 20, 2007

(65) Prior Publication Data

US 2008/0017154 A1 Jan. 24, 2008

Related U.S. Application Data

(60) Provisional application No. 60/807,973, filed on Jul. 21, 2006.

(51) Int. Cl.
*F01L 1/34* (2006.01)

(52) U.S. Cl. ..... 123/90.16; 123/90.39; 123/90.52

(58) Field of Classification Search ..... 123/90.16, 123/90.52, 90.39
See application file for complete search history.

(56) References Cited

U.S. PATENT DOCUMENTS

2003/0196620 A1* 10/2003 Spath ..... 123/90.16
2005/0247278 A1* 11/2005 Koshimizu et al. ..... 123/90.16

FOREIGN PATENT DOCUMENTS

DE 3239941 5/1984

* cited by examiner

*Primary Examiner*—Zelalem Eshete
(74) *Attorney, Agent, or Firm*—Lucas & Mercanti, LLP

(57) ABSTRACT

Proposed is a switchable valvetrain (1) for an internal combustion engine, having a row of rocker arms (2) which extend in the longitudinal direction of a cylinder head, which rocker arms (2) run via a recess (7) on an upper side (6) on a head (8) of a bearing journal (9), which bearing journal (9) is axially moveably arranged in a bore (10) of a carrier (11) which runs above, with piston-like coupling means (12) being provided for selectively coupling the bearing journal (9) to the carrier (11).

14 Claims, 1 Drawing Sheet

Fig.
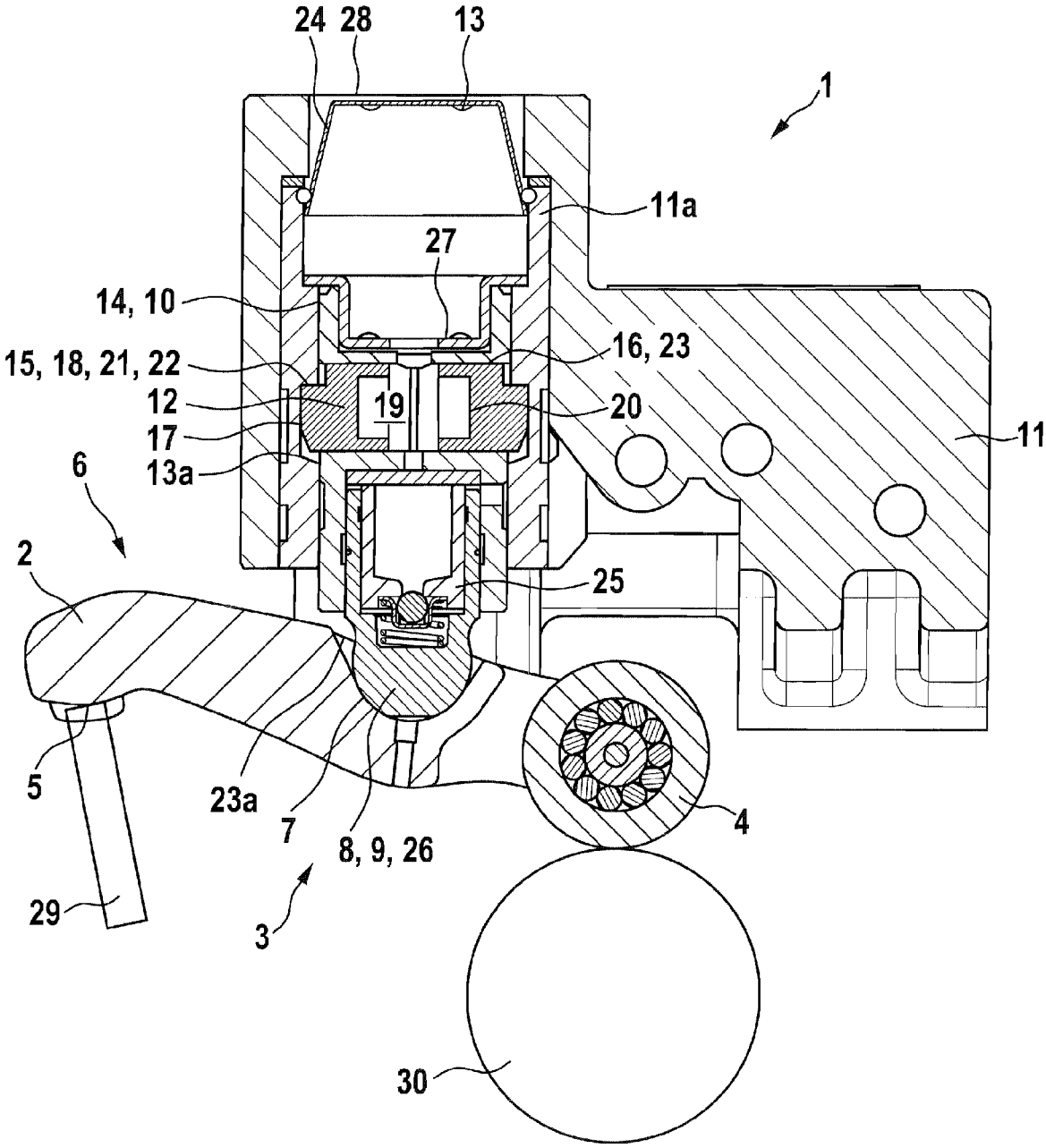

VALVETRAIN SWITCHABLE LEVER ARM FOR INTERNAL COMBUSTION ENGINE USING COLLAPSING PIVOT ELEMENT AT CENTER PIVOT

FIELD OF THE INVENTION

The invention relates to a switchable valvetrain for an internal combustion engine, having a row of rocker arms which extend in the longitudinal direction of a cylinder head, which rocker arms on the one hand intrinsically have, on an underside at one end, an at least indirect run-on face for at least one cam, and at the other end, a valve rest; and that run on the other hand via a recess on their upper side on a head of a bearing journal, with at least a subset of the bearing journals being axially moveably arranged in a corresponding bore of an above-situated carrier or of an insert part which is connected to the carrier, with each modular unit [moveable bearing journal/carrier or insert part] being assigned coupling means for selectively coupling the moveable bearing journal at least indirectly to the carrier, so that in the deployed state of the moveable bearing journal, a large valve lift is generated when coupled and a relatively small or zero valve lift is generated when decoupled, and with the respectively moveable bearing journal being acted on out of its bore by means of a lost motion spring.

BACKGROUND OF THE INVENTION

A valvetrain of said type is known from DE 32 39 941 A1 which is considered generic. A disadvantage of said valvetrain (see FIG. 1) is its extremely complexly designed coupling mechanism. Arranged laterally on the carrier is a bar-like slide which, in the coupled case, engages by means of a conical end face on one end into an annular groove of a bearing journal.

Said complex mechanism demands an unnecessarily large installation space in the cylinder head. It can be seen that the laterally engaging slide, with its surrounding construction, projects laterally beyond one end of the rocker arm. It is also clear that, as a result of the mere single-sided coupling, increased component loading in the coupled case can occur on the one hand, and the bearing journal has an increased tendency to tilt in the coupled case on the other hand. There are also only very few standard parts (previously used valvetrain parts) which can be resorted to.

OBJECT OF THE INVENTION

It is therefore the object of the invention to create a switchable valvetrain of the above-specified type, in which the stated disadvantages are eliminated.

ACHIEVEMENT OF THE OBJECT

According to the invention, said object is achieved in that an annular groove is arranged in the bore of the carrier or insert part, the at least axially upper annular face of which annular groove runs orthogonally with respect to the axial line of the bore of the carrier or insert part, with the bearing journal having at least one radially-running or secant-shaped recess which intersects its outer casing and in which, in the decoupled case, is seated at least one piston as a coupling means, which coupling means, proceeding from its radially outer face end, is of stepped design with a flattening situated above, and which coupling means, for the coupled case, can be displaced with its flattening in sections under the upper annular face of the annular groove of the bore of the carrier or insert part.

A valvetrain is therefore provided in which said disadvantages are eliminated. The integration of the coupling means into the journal saves radial installation space in the carrier/insert part. Hydraulic medium for the displacement of the coupling means (piston) (preferably hydraulically radially inward) can be very easily supplied out of the carrier/insert part. The annular groove for the coupling is very simple to form in production terms, with the contact pressure being kept low in the coupled case on account of the flattenings proposed in the claims. In addition, it is possible to dispense with a device for preventing the bearing journal from rotating with respect to its surrounding part.

Two pistons, situated diametrically opposite in a simple-to-produce through bore (if appropriate, two blind bores can also be considered) in the bearing journal should preferably be provided as a coupling means, so that a tendency of the bearing journal to tilt in the coupled case is prevented and the contact pressure is kept low. This arrangement also has the advantage that, should an insufficient "deployment" of one of the pistons occur after a triggered coupling command, at least the other piston provides support.

It is clear that, for example in the case of multi-valve technology, not every bearing journal need be designed so as to be switchable in the carrier.

The pistons can be displaced out particularly far radially in the coupling direction if their outer face end which faces toward the annular groove has a radii profile which correlates with that of the annular groove. A particularly good supporting surface is thereby formed.

Edge wear in the coupling region is avoided by means of corresponding bevels/roundings at the face-end-side "at the top" on the piston, and at the contact edge of the annular groove.

In general, a displacement of the coupling means in one direction by means of hydraulic medium and in the other direction likewise by means of hydraulic medium or by means of pressure spring force is conceivable and provided. A variety of possible combinations of adjustment means which are known per se are available to a person skilled in the art at this point.

It is alternatively possible, instead of the annular groove, for a bore or the like to also be provided for engaging the piston. Here, however, the bearing journal must preferably be prevented from rotating.

It is particularly preferable if the carrier is embodied as a continuous rail for at least one row or a partial section of one row of the rocker arms which extend in the longitudinal direction of the cylinder head. Said carrier can therefore, as is also proposed, be stored, delivered to the engine manufacturer and installed there, in a fully pre-assembled state with rocker arms suspended on the bearing journal.

The scope of protection of the invention also relates to a valvetrain having a carrier which, in a unipartite fashion, is assigned a plurality of rows of rocker arms which run in the longitudinal direction of the cylinder head. But alternatively, the carrier can also be assigned only to individual rocker arms or groups of rocker arms.

Clamp-like elements such as sheet metal or wire clamps, as are known per se, are suitable as connecting means of the rocker arm to the heads of the bearing journals. If appropriate, a jointed connection or the like is also conceivable.

In one physical embodiment, it is proposed to provide the valvetrain with hydraulic play compensation. For this purpose, it is proposed to provide the bearing journal with the play compensating device, so that said bearing journal is virtually in two parts and composed of a pressure piston with the head which is held in a guide bore of a housing as a further constituent part of the bearing journal. Complex mechanical play setting measures can therefore be dispensed with, but are indeed also conceivable.

It is conceivable and provided to couple the piston not directly to the annular groove in the carrier, but rather to provide a separate insert part for this purpose. The coupling mechanism with the bearing journal, play compensation, piston and insert part can therefore be placed into a receptacle of the carrier in a pre-assembled state. An outer casing of the insert part is held fixedly in the receptacle of the carrier.

The lost motion spring which is required for the decoupled case is, according to a further expansion of the invention, embodied as at least one coil or spiral pressure spring, and should act at one end against a face end of the bearing journal, and at the other end against a base of the bore of the carrier. The base of the bore of the carrier can be connected in a unipartite fashion to the carrier, with it however also being provided to apply a separate plug, a holding cap etc. in said region.

DESCRIPTION OF THE DRAWING

Illustrated is a switchable valvetrain 1 for an internal combustion engine. Said switchable valvetrain 1 is composed of an "overhead" carrier 11 for a row of rocker arms 2 which extend in the longitudinal direction of a cylinder head. The rocker arm 2 illustrated here has, on its underside 3 at one end, a run-on face 4 (rolling-bearing-mounted roller) for a cam 30, and at the other end a valve rest 5 for at least one gas exchange valve 29.

Between the ends, on an upper side 6, the respective rocker arm 2 has a spherical-cap-shaped recess 7. A head 8 of a bearing journal 9 runs in said recess 7. The head 8 is a constituent part of a pressure piston 26 of a hydraulic play compensating device 25. The bearing journal 9, which therefore has the play compensating device 25, runs with its outer casing 14 in a downwardly open bore 10 of the carrier 11/insert part 11*a*. Said bearing journal 9 is held in a telescopically moveable mariner relative to said bore 10. As can also be seen, the bore 10 of the carrier 11/insert part 11*a* has an annular groove 13*a*. At least the upper annular face 15 of said annular groove 13*a* runs perpendicularly with respect to the axial line of the bearing journal 9.

Running orthogonally with respect to the longitudinal direction of the carrier 11 (a cross section is shown) in the bearing journal 9 is a recess 16, which is formed as a through bore 23, with two pistons situated diametrically opposite as coupling means 12. Said pistons 12 are shown in their state in which they are engaged into the annular groove 13*a* (coupled state). Said pistons 12 have, proceeding from their radially outer face end 17, one flattening 18 each on their upper side, which flattening 18, in the coupled case, lies under the upper annular face 15 of the annular groove 13*a*. The coupling state disclosed can for example be produced by the force of a spring means 19, such as at least one coil pressure spring, which acts between the inner face ends 20 of the pistons 12 (cam base circle phase). A return displacement into the decoupled position is carried out by means of a hydraulic medium which is supplied to an outer face end 17 of the respective piston 12 from the carrier 11/insert part 11*a*. The outer face ends 17 of the pistons 12 can additionally be designed so as to follow the curvature of the annular groove 13*a*.

In addition, it is disclosed in the drawing that a lost motion spring 13 is integrated within the bore 10 of the carrier 11/insert part 11*a*. Said lost motion spring 13 is seated at one end against a face end 27, which faces away from the rocker arm 2 of the bearing journal 9, and acts at the other end against a base 28 of the bore 10. A cover-like element 24 is applied here as a base 28.

In order to avoid edge wear, it is proposed to bevel an edge region 21 of the upper annular face 15 of the annular groove 13*a*, and likewise an edge region 22 of the flattening 18 of the respective radially outer face end 17 of the piston 12.

It is also provided to retain the respective rocker arm 2 pivotably on the head 8 of the bearing journal 9 by means of a connecting means 23*a* such as a thin-walled holding clamp which is formed in the region of the recess 7 of said rocker arm 2. The entire modular unit (carrier 11 with insert parts 11*a*, bearing journal 9, rocker arms 2 suspended on the latter . . . ) can be stored, delivered to the engine manufacturer and installed there, in a pre-assembled state. The assembly expenditure at the engine manufacturer is therefore drastically reduced.

LIST OF REFERENCE SYMBOLS

1) Valvetrain
2) Rocker arm
3) Underside
4) Run-on face
5) Valve rest
6) Upper side
7) Recess
8) Head
9) Bearing journal
10) Bore
11) Carrier
11*a*) Insert part
12) Coupling means, piston
13) Lost motion spring
13*a*) Annular groove
14) Outer casing
15) Upper annular face
16) Recess
17) Outer face end
18) Flattening
19) Spring means
20) Inner face end
21) Edge region, annular groove
22) Edge region, flattening
23) Through bore
23*a*) Connecting means
24) Plug/element
25) Play compensating device
26) Pressure piston
27) Face end
28) Base
29) Gas exchange valve
30) Cam

The invention claimed is:

1. A switchable valvetrain for an internal combustion engine, comprising:

a row of rocker arms which extend in a longitudinal direction of a cylinder head, which intrinsically have, on an underside at one end, an at least indirect run-on face for at least one cam, and at an other end, a valve rest and on an upper side a recess in which a head of a bearing journal sits, with at least a subset of the bearing journal being axially moveably arranged in a corresponding bore of an above-situated carrier or of an insert part which is connected to the carrier, with each modular unit being assigned coupling means for selectively coupling the moveable bearing journal at least indirectly to the carrier, so that in a deployed state of the moveable bearing journal, a large valve lift is generated when coupled and a relatively small or zero valve lift is generated when decoupled, and with the moveable bearing journal being acted on out of the bore by means of a lost motion spring, wherein an annular groove is arranged in the bore of the carrier or the insert part, the at least axially upper annular face of which the annular groove runs orthogonally with respect to an axial line of the bore of the carrier or the insert part, with the bearing journal having at least one radially-running or secant-shaped recess which intersects an outer casing and in which, in a decoupled case, is seated at least one piston as a coupling means, which, proceeding from a radially outer face end, is of a stepped design with a flattening situated above, and which coupling means, for a coupled case, can be displaced with its flattening in sections under the upper annular face of the annular groove of the bore of the carrier or insert part, and wherein the bearing journal has a hydraulic play compensating device whose pressure piston is a constituent part of the bearing journal and has the head.

2. The valvetrain of claim 1, wherein two pistons situated diametrically opposite are provided in the recess, which is formed as a through bore, of the bearing journal.

3. The valvetrain of claim 1, wherein a displacement of the piston for the coupled case is effected radially outward by at least one mechanical spring means running in the recess which interacts with a radially inner face end of the piston, with a return displacement of the piston for the decoupled case taking place radially inward by means of hydraulic medium which can be supplied out of the carrier or the insert part in front of the radially outer face end of said piston.

4. The valvetrain of claim 1, wherein the outer face end, which faces toward the annular groove, of the piston has a curvature which correlates at least approximately with a radius of the annular groove.

5. The valvetrain of claim 1, wherein edge regions, which are in engagement with one another, of the annular groove and of the flattening of the piston, are beveled in a transition region to the outer face end.

6. The valvetrain of claim 1, wherein the carrier is embodied as a continuous rail for at least one row or at least a partial section of one row of the rocker arms which extend in the longitudinal direction of the cylinder head.

7. The valvetrain of claim 1, wherein the carrier is produced from a lightweight material.

8. A method for assembling the valvetrain according to claim 1, wherein the valvetrain is provided fully pre-assembled with rocker arms retained thereon in a suspended manner by connecting means, and is subsequently mounted as a modular unit on the cylinder head of the internal combustion engine.

9. The valvetrain of claim 1, wherein the rocker arm is retained on the head of the bearing journal by a connecting means.

10. The valvetrain of claim 1, wherein the lost motion spring runs in the bore of the carrier or insert part, is embodied as at least one coil or spiral pressure spring, and acts at one end against a face end, which faces away from the rocker arm of the bearing journal, and at the other end against a base, which is closed off either in a unipartite fashion or by means of a separate plug or a separate pot-like element, of the bore of the carrier insert part.

11. The valvetrain of claim 1, wherein the mechanical spring means is a coil pressure spring.

12. The valvetrain of claim 7, wherein lightweight material is aluminum.

13. The valvetrain of claim 8, wherein the connecting means are clamps.

14. The valvetrain of claim 9, wherein the connecting means are a thin-walled clamp or a joint.

* * * * *